US010760170B2

(12) United States Patent
Fleischer et al.

(10) Patent No.: US 10,760,170 B2
(45) Date of Patent: Sep. 1, 2020

(54) REDUCTION METHOD AND ELECTROLYSIS SYSTEM FOR ELECTROCHEMICAL CARBON DIOXIDE UTILIZATION

(71) Applicant: Siemens Aktiengesellschaft, Munich (DE)

(72) Inventors: Maximilian Fleischer, Höhenkirchen (DE); Philippe Jeanty, München (DE); Ralf Krause, Herzogenaurach (DE); Erhard Magori, Feldkirchen (DE); Nayra Sofia Romero Cuéllar, München (DE); Bernhard Schmid, Erlangen (DE); Günter Schmid, Hemhofen (DE); Kerstin Wiesner-Fleischer, Höhenkirchen-Siegertsbrunn (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 260 days.

(21) Appl. No.: 15/739,738

(22) PCT Filed: May 31, 2016

(86) PCT No.: PCT/EP2016/062253
§ 371 (c)(1),
(2) Date: Dec. 24, 2017

(87) PCT Pub. No.: WO2017/005411
PCT Pub. Date: Jan. 12, 2017

(65) Prior Publication Data

US 2018/0179649 A1 Jun. 28, 2018

(30) Foreign Application Priority Data

Jul. 3, 2015 (DE) ..... 10 2015 212 503

(51) Int. Cl.
*C25B 15/08* (2006.01)
*C25B 3/04* (2006.01)
(Continued)

(52) U.S. Cl.
CPC ..... *C25B 15/08* (2013.01); *C25B 1/00* (2013.01); *C25B 3/04* (2013.01); *C25B 9/06* (2013.01)

(58) Field of Classification Search
CPC ..... C25B 1/00; C25B 3/04; C25B 15/08
See application file for complete search history.

(56) References Cited

U.S. PATENT DOCUMENTS

2012/0228148 A1 9/2012 Wolfowitz ..... 205/462
2013/0105304 A1* 5/2013 Kaczur ..... C25B 9/10 204/237
2013/0116474 A1* 5/2013 Teamey ..... C25B 1/00 568/852
2018/0023202 A1* 1/2018 Krause ..... C25B 15/08 205/440
2018/0195184 A1* 7/2018 Fleischer ..... C25B 15/08
(Continued)

FOREIGN PATENT DOCUMENTS

CN 104722177 A 6/2015 ..... B01D 53/18
DE 102013226357 A1 6/2015 ..... C25B 11/06
(Continued)

OTHER PUBLICATIONS

Chinese Office Action, Application No. 201680039557.3, 5 pages, dated Dec. 6, 2018.
(Continued)

*Primary Examiner* — Steven A. Friday
(74) *Attorney, Agent, or Firm* — Slayden Grubert Beard PLLC

(57) ABSTRACT

The present disclosure relates to electrolysis. For example, an electrolysis system for carbon dioxide utilization may
(Continued)

include: an electrolysis cell having an anode and a cathode, where carbon dioxide reduces at the cathode to at least one hydrocarbon compound or to carbon monoxide; first and second electrolyte reservoirs; a first product gas line from the first electrolyte reservoir; a second product gas line from the second electrolyte reservoir; a first connecting line supplying electrolyte from the first electrolyte reservoir to the anode; a second connecting line taking electrolyte from the anode to the second electrolyte reservoir; a third connecting line supplying electrolyte from the second electrolyte reservoir to the cathode; a fourth connecting line taking electrolyte from the cathode off to the first electrolyte reservoir; and a pressure-equalizing connection directly connecting the first and second electrolyte reservoirs.

18 Claims, 2 Drawing Sheets

(51) Int. Cl.
*C25B 1/00* (2006.01)
*C25B 9/06* (2006.01)

(56) References Cited

U.S. PATENT DOCUMENTS

| | | | | |
|---|---|---|---|---|
| 2018/0257057 | A1* | 9/2018 | Motoshige | B01J 19/245 |
| 2018/0274113 | A1* | 9/2018 | Kitagawa | C25B 1/003 |
| 2019/0078222 | A1* | 3/2019 | Baldauf | C25B 1/00 |
| 2019/0292668 | A1* | 9/2019 | Fujinuma | C25B 9/08 |

FOREIGN PATENT DOCUMENTS

| | | | | |
|---|---|---|---|---|
| WO | 2017/005411 | A1 | 1/1917 | C25B 1/00 |
| WO | 2015/143560 | A1 | 10/2015 | C25B 15/08 |

OTHER PUBLICATIONS

German Office Action, Application No. 102015212503.3, 7 pages, dated Mar. 11, 2016.
International Search Report and Written Opinion, Application No. PCT/EP2016/062253, 22 pages, dated Jul. 14, 2016.
Australian Notice of Acceptance, Application No. 2016290263, 3 pages, dated Aug. 20, 2018.

* cited by examiner

REDUCTION METHOD AND ELECTROLYSIS SYSTEM FOR ELECTROCHEMICAL CARBON DIOXIDE UTILIZATION

CROSS-REFERENCE TO RELATED APPLICATIONS

This application is a U.S. National Stage Application of International Application No. PCT/EP2016/062253 filed May 31, 2016, which designates the United States of America, and claims priority to DE Application No. 10 2015 212 503.3 filed Jul. 3, 2015, the contents of which are hereby incorporated by reference in their entirety.

TECHNICAL FIELD

The present disclosure relates to electrolysis. Teachings thereof may be embodied in methods and electrolysis systems for electrochemical utilization of carbon dioxide wherein carbon dioxide is introduced into an electrolysis cell and reduced at a cathode.

BACKGROUND

Currently around 80% of the worldwide energy demand is met by the combustion of fossil fuels, the burning of which gives rise to worldwide annual atmospheric emissions of approximately 34 000 million tonnes of carbon dioxide. This release into the atmosphere is the major contribution of carbon dioxide, which in the case of a lignite power station, for example, can be up to 50 000 tonnes per day. Carbon dioxide is one of the gases known as greenhouse gases, whose negative effects on the atmosphere and the climate are debated. Since carbon dioxide occupies a very low position thermodynamically, it is difficult to reduce it to give reusable products, a fact which has left the actual recycling of carbon dioxide to date within the realm of theory or of academia. Natural breakdown of carbon dioxide is accomplished, for example, by photosynthesis. A replica of the natural photosynthesis process using industrial photocatalysis has to date lacked adequate efficiency.

One alternative is the electrochemical reduction of carbon dioxide. Systematic studies of the electrochemical reduction of carbon dioxide are still a relatively young field of development. Efforts to develop an electrochemical system able to reduce an acceptable volume of carbon dioxide only emerged a few years ago. Laboratory-scale research efforts have shown that, preferentially, metals are to be used as catalysts for the electrolysis of carbon dioxide. While carbon dioxide is reduced almost exclusively to carbon monoxide at silver, gold, zinc, palladium, and gallium cathodes, for example, the reaction products at a copper cathode comprise a multitude of hydrocarbons.

FIG. 1 shows a construction of an electrolysis system according to the prior art. The construction exhibits an electrolysis cell 1 having an anolyte circuit and a catholyte circuit 20 and 21, separated by means for example of an ion exchange membrane in the electrolysis cell. In this case, typically, different electrolytes are used in the anolyte and catholyte circuits. These electrolytes are held in reservoirs 201 and 211, where they are cleaned. A typical construction, shown in simplified form, of an electrolysis system comprises an electrolysis cell having an anolyte circuit and a catholyte circuit. These circuits are separated from one another in the electrolysis cell by means of an ion exchange membrane. The respective electrolyte is held in reservoirs, where it is cleaned.

If the electrolyte used in both circuits is the same, prolonged operation of the electrolysis is accompanied by changes both in the pH and also in the ion concentration in the individual solutions. The membrane additionally complicates the construction. If, for example, the anolyte and catholyte used comprise a 0.5 M KHCO3 solution, the cell voltage after a couple of hours increases sharply, since the cations have migrated from the anolyte chamber into the catholyte chamber to the electrode as a result of the electrical voltage applied. Although the osmotic pressure is compensated to start with, or even counteracted after a certain time, the electrical attraction of the cathode is stronger and the migration of cations proceeds primarily in one direction. If the initial concentration is raised or the anolyte is periodically renewed, crystallization of KHCO3 in the catholyte can be found after a few hours. Similar comments also apply in respect of electrolytes whose electrical conductivity is generated by other salts (sulfates, phosphates).

SUMMARY

It is therefore necessary for the electrolyte to be regenerated separately. To enable a continual flow of electrolyte, therefore, a sufficient amount of electrolyte must be present in the reservoirs. In a large-scale industrial plant, this necessitates tanks of a considerable size. The teachings of the present disclosure may provide an electrolysis system and also a method for the electrochemical utilization of carbon dioxide, said system and said method alleviating or obviating the problems identified above.

For example, in some embodiments an electrolysis system (100) for carbon dioxide utilization may include: an electrolysis cell (1) having an anode (4) in an anode chamber (2) and having a cathode (5) in a cathode chamber (3), where the cathode chamber (3) is designed to accommodate carbon dioxide and bring it into contact with the cathode (5), where catalysis is enabled of a reduction reaction of carbon dioxide to at least one hydrocarbon compound or to carbon monoxide. In addition, the system may include first and second electrolyte reservoirs (6, 7), a first product gas line (14) from the first electrolyte reservoir (6), and a second product gas line (15) from the second electrolyte reservoir (7). Also, there may be a first connecting line (9) for supplying electrolyte from the first electrolyte reservoir (6) to the anode chamber (2), a second connecting line (10) for taking electrolyte from the anode chamber (2) off to the second electrolyte reservoir (7), a third connecting line (11) for supplying electrolyte from the second electrolyte reservoir (7) to the cathode chamber (3), a fourth connecting line (12) for taking electrolyte from the cathode chamber (3) off to the first electrolyte reservoir (6), and a pressure-equalizing connection (13) which directly connects the first and second electrolyte reservoirs (6, 7).

In some embodiments, there is a pump (42) in the pressure-equalizing connection.

In some embodiments, there are level sensors for both reservoirs.

In some embodiments, the two electrolyte reservoirs (6, 7) are together designed as an individual container having a dividing wall (32) for subdivision into the two electrolyte reservoirs (6, 7), where the dividing wall (32) has an opening (33) as pressure-equalizing connection.

In some embodiments, there are means for the introduction of inert gas, especially nitrogen, into the reservoirs.

In some embodiments, there is a supply line for supplying the carbon dioxide.

In some embodiments, the supply line for supplying the carbon dioxide has an overpressure valve.

In some embodiments, the supply line and the first product gas line are brought together.

In some embodiments, the product gas lines are brought together in an overpressure valve.

As another example, a reduction method for carbon dioxide utilization by means of an electrolysis system (100), may include carbon dioxide is passed through a cathode chamber (3) of an electrolysis cell (1) and is brought into contact with a cathode (5). A reduction reaction of carbon dioxide to at least one hydrocarbon compound or to carbon monoxide is carried out. A first product gas is passed by means of a first product gas line (14) out of the first electrolyte reservoir (6). A second product gas is passed by means of a second product gas line (15) out of the second electrolyte reservoir (7). The electrolyte is passed in a crossflow into and out of the electrolyte cell (1), by electrolyte being passed from a first of two electrolyte reservoirs (6) to the anode chamber (2). Electrolyte is passed from the anode chamber (2) to a second of the two electrolyte reservoirs (7). Electrolyte is passed from the second electrolyte reservoir (7) to the cathode chamber. Electrolyte is passed from the cathode chamber (3) to the first electrolyte reservoir (6). A similar liquid level in the electrolyte reservoirs is brought about by means of a pressure-equalizing connection (13) between the first and second electrolyte reservoirs (6, 7).

BRIEF DESCRIPTION OF THE DRAWINGS

Examples and embodiments of teachings of the present disclosure are described again exemplarily with reference to FIGS. 1 to 4 of the appended drawing. In the drawing, in diagrammatic representation.

DETAILED DESCRIPTION

Figure 1:
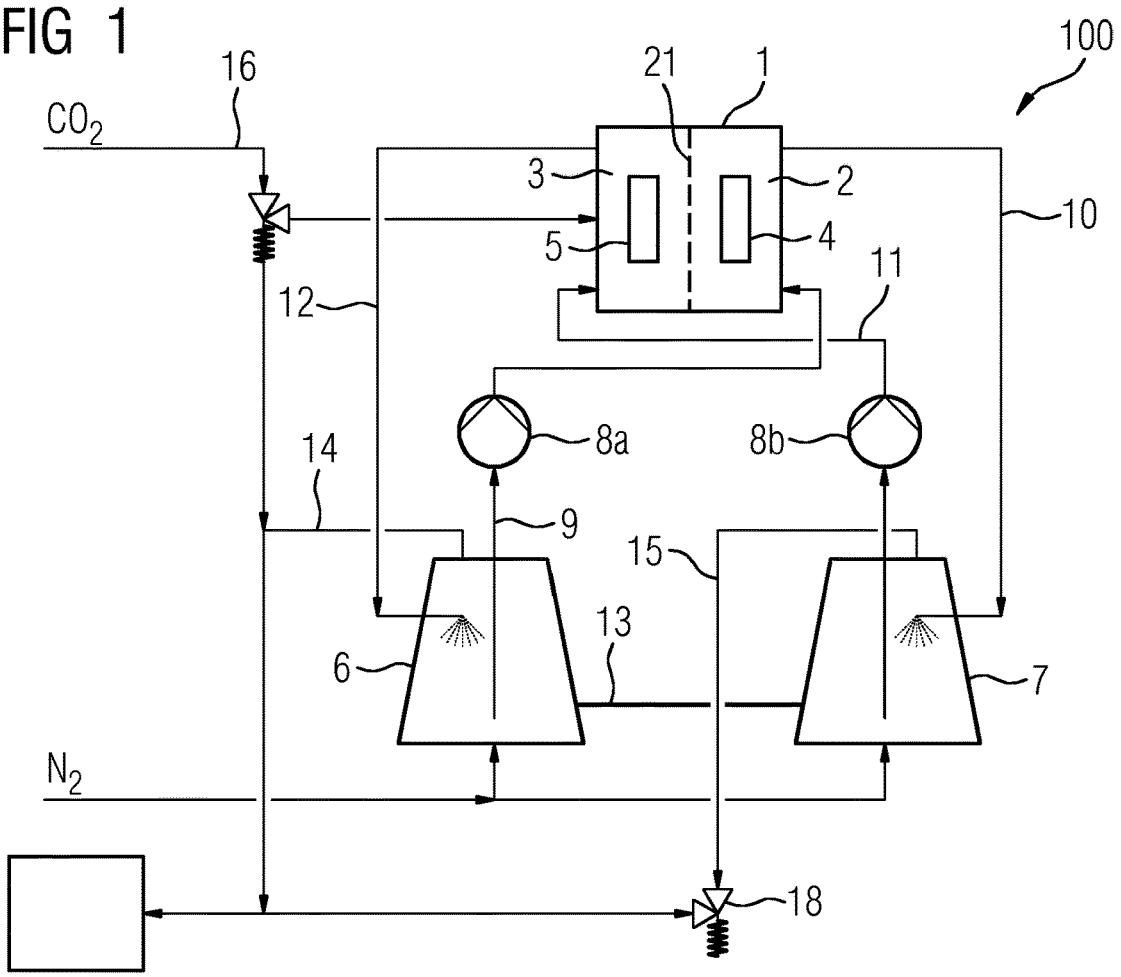
FIG. 1 shows an electrolysis system, according to teachings of the present disclosure.

The electrolysis system of the present disclosure for carbon dioxide utilization, may include:

- an electrolysis cell having an anode in an anode chamber and having a cathode in a cathode chamber, where the cathode chamber is designed to accommodate carbon dioxide and bring it into contact with the cathode, where catalysis is enabled of a reduction reaction of carbon dioxide to at least one hydrocarbon compound or to carbon monoxide,
- first and second electrolyte reservoirs,
- a first product gas line from the first reservoir, and
- a second product gas line from the second reservoir.

The system may further comprise:

- a first connecting line for supplying electrolyte from the first electrolyte reservoir to the anode chamber,
- a second connecting line for taking electrolyte from the anode chamber off to the second electrolyte reservoir,
- a third connecting line for supplying electrolyte from the second electrolyte reservoir to the cathode chamber, and
- a fourth connecting line for taking electrolyte from the cathode chamber off to the first electrolyte reservoir.

In some embodiments, a reduction method for carbon dioxide utilization by means of an electrolysis system, may include:

- carbon dioxide is passed through a cathode chamber of an electrolysis cell and is brought into contact with a cathode,
- a reduction reaction of carbon dioxide to at least one hydrocarbon compound or to carbon monoxide is carried out,
- first product gas is passed by means of a first product gas line out of the first reservoir,
- second product gas is passed by means of a second product gas line out of the second reservoir.

Furthermore, the electrolyte is passed in a crossflow into and out of the electrolysis cell, by

- electrolyte being passed from a first of two electrolyte reservoirs to the anode chamber,
- electrolyte being passed from the anode chamber to a second of the two electrolyte reservoirs,
- electrolyte being passed from the second electrolyte reservoir to the cathode chamber,
- electrolyte being passed from the cathode chamber to the first electrolyte reservoir.

The effect of passing the electrolyte in the crossed flow (crossflow) is that changes occurring in pH are compensated again.

If cations migrate to the cathode, they are transported back again into the anode chamber mechanically by way of the crossflow. A further effect is that the salt concentration in the two electrode chambers remains constant and so salting-out is durably prevented. On the basis of this operating regime, ongoing electrolysis with the same electrolyte in both electrode chambers is possible.

In some embodiments, the electrolysis system comprises a pressure-equalizing connection which directly connects the first and second electrolyte reservoirs. Inequalities in the flow of the electrolyte from the two reservoirs may over prolonged periods, without countermeasures, lead to an unequal electrolyte level in the two reservoirs and even, in the extreme case, to one side of the cell running dry. The pressure-equalizing connection establishes a direct connection of the two reservoirs, which as a result acquire a continually equal liquid level, in analogy to communicating pipes. This prevents one side of the cell running dry.

For the exchange of the liquid electrolyte it is useful for the compensating line at both electrolyte reservoirs to be connected as far downward as possible, as for example in the lower half of the height of the respective reservoir, more particularly in the lower quarter.

In addition to automatic equalization of the liquid level in the reservoirs, it is also possible to carry out a regulated exchange of electrolyte. For that purpose, then, in some embodiments, a pump is present in the pressure-equalizing connection. This pump ensures forced exchange of electrolyte. Control may be carried out using the input signals of fill level sensors for both reservoirs.

In some embodiments, the two reservoirs are separate vessels, in which case the pressure-equalizing connection takes the form, for example, of a pipe between the vessels. In some embodiments, the two reservoirs may be an individual vessel with a dividing wall for subdivision into the two reservoirs, with the dividing wall having an opening as pressure-equalizing connection. The opening as well, of course, may be located in the lower region of the reservoirs, to allow an exchange of the liquid electrolyte even when the liquid level is low.

In some embodiments, the electrolysis system comprises pumps in the first and third connecting lines which convey the electrolyte to anode chamber and cathode chamber. Furthermore, the electrolysis system may comprise a supply line for supplying the carbon dioxide.

In some embodiments, the electrolysis system comprises means for pressure regulation for at least one of the reservoirs. Thus, for example, the feedline for supplying the carbon dioxide may have an overpressure valve. If this valve opens, the carbon dioxide which then flows through can be mixed with the product gas from the first product gas line and the gases can be passed together to an analytical facility and/or to a product gas storage facility. In some embodiments, the product gas lines are brought together in an overpressure valve. As a result, through a suitable choice of the overpressure valve, an equal pressure is ensured in the gas phase in the reservoirs.

In some embodiments, electrolysis system comprises means for the introduction of inert gas, e.g., nitrogen, into the reservoirs. For this purpose, the inlets at the reservoirs may be disposed in the lower region of the respective reservoir, and in the lower region the reservoirs comprise a layer of glass frit which is pervious for the inert gas.

In some embodiments, the cathode of the electrolysis system comprises silver, copper, copper oxide, titanium dioxide, or another metal-oxide semiconductor material. The cathode may also, for example, be a photocathode, in which case it would be possible to operate a photoelectrochemical reduction process for the utilization of carbon dioxide, known as photoassisted $CO_2$ electrolysis. In some embodiments, this system can operate purely photocatalytically. In some embodiments, the electrolysis system comprises a platinum anode. In some embodiments, KHCO3, K2SO4, and K3PO4 are used as electrolyte salts in different concentrations. In some embodiments, potassium iodide KI, potassium bromide KBr, potassium chloride KCl, sodium hydrogencarbonate $NaHCO_3$, sodium sulfate $Na_2SO_4$ are used. Other sulfates, phosphates, iodides, or bromides, however, can also be used for increasing the conductivity in the electrolyte. As a result of continual supplying of the carbon-containing gas, there is no need to supply carbonates and/or hydrogencarbonates, which are instead formed in the cathode chamber in operation.

In some embodiments, the cathode (K) has, for example, a surface protection layer. In some embodiments, semiconductor photocathodes, but also, in particular, metallic cathodes, have a surface protection layer. By a surface protection layer is meant that a layer which is relatively thin in comparison to the overall electrode thickness separates the cathode from the cathode chamber. The surface protection layer for this purpose may comprise a metal, a semiconductor, or an organic material. In some embodiments, this is a protective titanium dioxide layer.

The primary aim of the protective effect is to protect the electrode from attack by the electrolyte or by reactants, products or catalysts, and their dissociated ions, in solution in the electrolyte, with consequent dissolving of ions from the electrode, for example. With regards specifically to the electrochemical reduction method in aqueous media, or at least in a medium which contains small quantities of water or of hydrogen, a suitable surface protection layer is very important for the long life and functional stability of the electrode in the process. Even small morphological changes, as a result of corrosive attacks, for example, may influence the overvoltages of hydrogen gas $H_2$ or carbon monoxide gas CO in aqueous electrolytes or water-bearing electrolyte systems. The consequence would be, on the one hand, a drop in the current density and, accordingly, a very low system efficiency for the conversion of carbon dioxide, and, on the other hand, the mechanical destruction of the electrode.

The electrolysis system 100 shown diagrammatically in FIG. 1 first has, as central element, an electrolysis cell 1, which is here depicted in a two-compartment construction. An anode 4 is arranged in an anode chamber 2, and a cathode 5 in a cathode chamber 3. Anode chamber 2 and cathode chamber 3 are separated from one another by a membrane 21. This membrane 21 may be an ion-conducting membrane 21, as for example an anion-conducting membrane 21 or a cation-conducting membrane 21. The membrane 21 may be a porous layer or a diaphragm. The membrane 21 may also, ultimately, be understood as a three-dimensional, ion-conducting separator which separates electrolytes in anode chamber and cathode chamber 2, 3. To introduce the carbon dioxide $CO_2$ into the electrolysis cell 1, the latter comprises a gas diffusion electrode.

Anode 4 and cathode 5 are each connected electrically to a voltage supply. The anode chamber 2 and the cathode chamber 3 of the electrolysis cell 1 shown are each equipped with an electrolyte inlet and electrolyte outlet, via which the electrolyte and also electrolysis byproducts, e.g., oxygen gas $O_2$, from the anode chamber 2 or cathode chamber 3, respectively, are able to flow in and out.

Anode chamber 2 and cathode chamber 3 are tied into an electrolyte circuit via first to fourth connecting lines (9 . . . 12). The flow directions of electrolyte are shown by means of arrows in both circuits. Also tied into the electrolyte circuit, moreover, are first and second reservoirs 6, 7, in which the electrolyte is held. The electrolyte circuit here, unlike known carbon dioxide electrolysis plants, takes the form of a crossflow. To this end, a first of the connecting lines 9 passes electrolyte and, where appropriate, reactants and products mixed therewith or dissolved therein from the first reservoir 6, conveyed by a pump 8*a*, to the anode chamber 2 and its electrolyte inlet.

From the electrolyte outlet of the anode chamber 2, in turn, a second connecting line 10 passes the electrolyte with admixed substances to the second reservoir 7. The electrolyte is therefore not returned to the original reservoir 6. Electrolyte from the second reservoir 7, in turn, is conveyed through a third connecting line 11 by means of a pump 8*b* to the cathode chamber 3. Electrolyte from the cathode chamber 3 is passed via a fourth connecting line 12 to the first reservoir 6. In this way, a crossed circuit is produced for the electrolytes, in which a given amount of electrolyte, over time and at least in parts, reaches and travels through not only both reservoirs but also anode and cathode chambers 2 and 3.

The reservoirs 6 and 7 are connected by means of an equalizing pipe 13. The outlets to the equalizing pipe 13 in the reservoirs 6 and 7 are usefully located in the lower part of the reservoirs, to allow the exchange of liquid even when the liquid level is low. The equalizing pipe 13 ensures that neither of the reservoirs 6 and 7 can run empty, and the height of the electrolyte level is the same in both.

Figure 2:
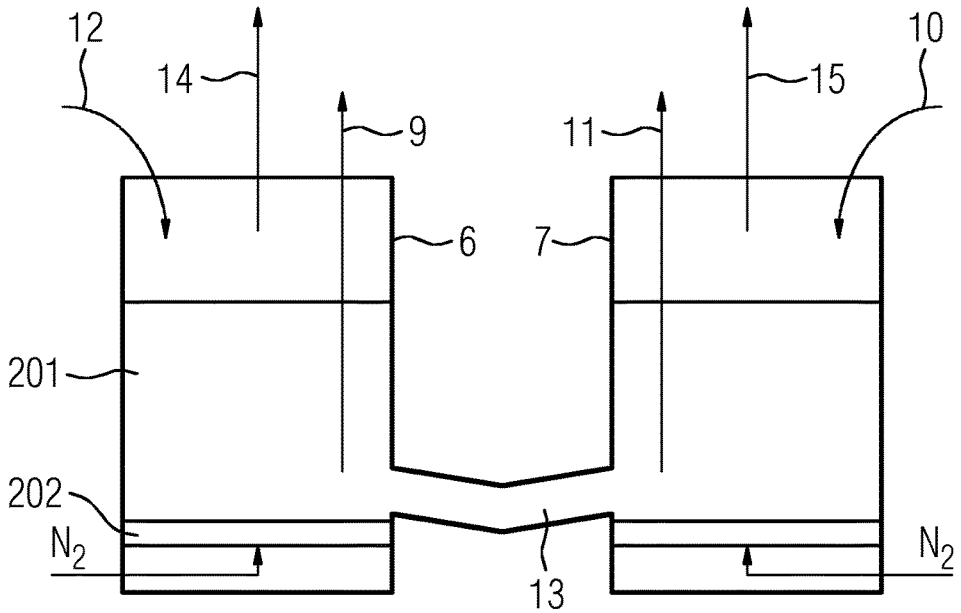
FIG. 2 shows connected electrolyte reservoirs with pressure-equalizing line, according to teachings of the present disclosure.

FIG. 2 shows a more detailed view of the two reservoirs 6 and 7. The effect of operation in the form of a crossed circuit with two separate reservoirs 6 and 7 is that the resulting products, such as O2 at the anode 4 and CO at the cathode 5, for example, are transported separately and separated from the liquid in the reservoirs 6 and 7. Product gas is removed by means of a gas scrubber. Nitrogen N2, for example, is introduced into the bases of the reservoirs 6 and 7, dispersed via a layer 202 of glass frit. This inert gas drives the dissolved gases O2, CO and CO2 out of the electrolyte. As a result, typically, the electrolyte does not in fact become gas-free, but there is a certain amount of a certain gas in solution in it. Depending on application, CO2 or other inert gases may be used instead of N2. Diluted with the inert gas, the products are discharged from the circuit and subsequently analyzed and purified.

Leading out of the first reservoir 6 is a first product gas line 14. This line connected via a first overpressure valve to a supply line 16 for carbon dioxide, which transports the carbon dioxide to the electrolysis cell 1. Via this connection it is possible optionally for carbon dioxide, which if the pressure is exceeded is in part not delivered into the electrolysis cell 1, and also product gas, together with the inert gas from the first reservoir 6, to be passed to an analytical facility and to a product storage facility that is not shown in FIG. 1. The amount of carbon dioxide introduced can be used to calculate the yield.

A second product gas line 15 from the second reservoir 7 passes together with the joint line, consisting of first product gas line 14 and carbon dioxide supply line 16, to a second overpressure valve 18. This controlled merging of the product gas lines 14, 15 from the reservoirs 6, 7 ensures that the pressure in both reservoirs 6, 7 is the same and therefore that the liquid level is not displaced. In some embodiments, a regulated pressure control system monitors the differential pressure at the GDE, so that the latter does not suffer excessive mechanical loading. The second overpressure valve 18 is set so as to ensure that no product gas of the anode 4 enters the analytical facility.

In some embodiments, at the mixing of H2 and O2, care is taken to ensure that the dilution with N2 is sufficient not to produce an explosive detonating-gas mixture. If this point cannot be ensured, then the two gas streams should be kept separate, and pressure equalization takes place via a separate mechanism.

FIG. 2 also shows the equalization pipe 13 between the two reservoirs 6, 7. The filling quantity of the reservoirs 6, 7 changes in the case of the crossed circulation described unless the two pump flow rates are exactly the same. While this can be achieved via a level measurement and via regulation of the pump output, such control is costly, inconvenient, and susceptible to error. In some embodiments, there is an equalizing pipe 13 between the reservoirs 6, 7, by means for example of a pipe having a diameter which is small by comparison with the dimensions of the electrolyte vessels (1:100). This allows pressure equalization to take place according to the principle of communicating pipes, but has only a minimal volume flow rate which can lead to product mixing. In the case of gaseous products, it is appropriate rationally to mount this equalization pipe 13 at the bottom in the electrolyte vessel.

Figure 3:
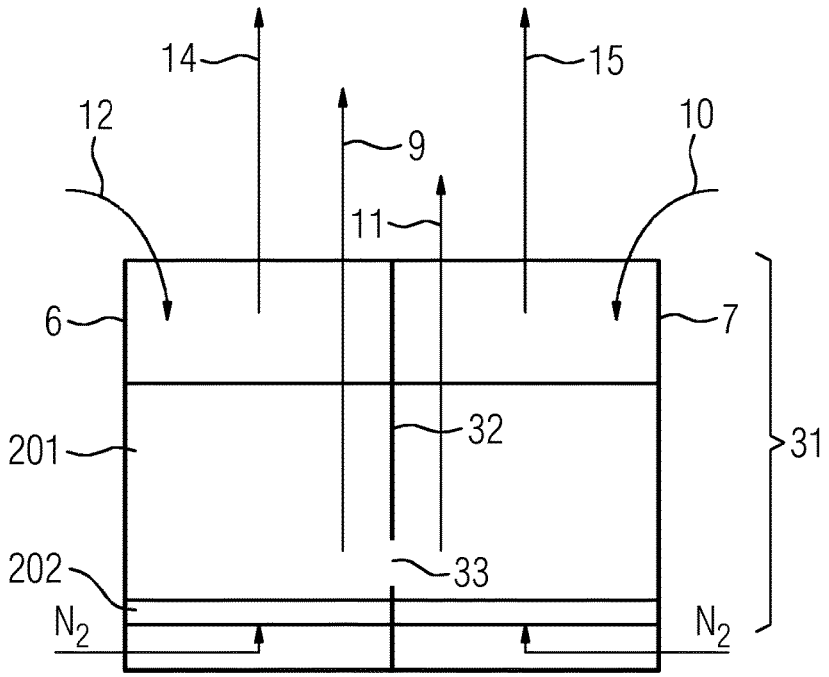
FIG. 3 shows connected electrolyte reservoirs as a vessel with a dividing wall, according to teachings of the present disclosure.

Another embodiment of the two reservoirs 6, 7 is shown in FIG. 3. In this case the reservoirs 6, 7 are designed as a common container 31. The container 31 comprises a dividing wall 32, which has an interruption or an opening 33. The opening 33 is appropriately located in the lower part of the container 31, to allow continual exchange of the electrolyte between the reservoirs 6, 7. The common container results largely in the same functionality as in the case of the separate reservoirs 6, 7.

Figure 4:
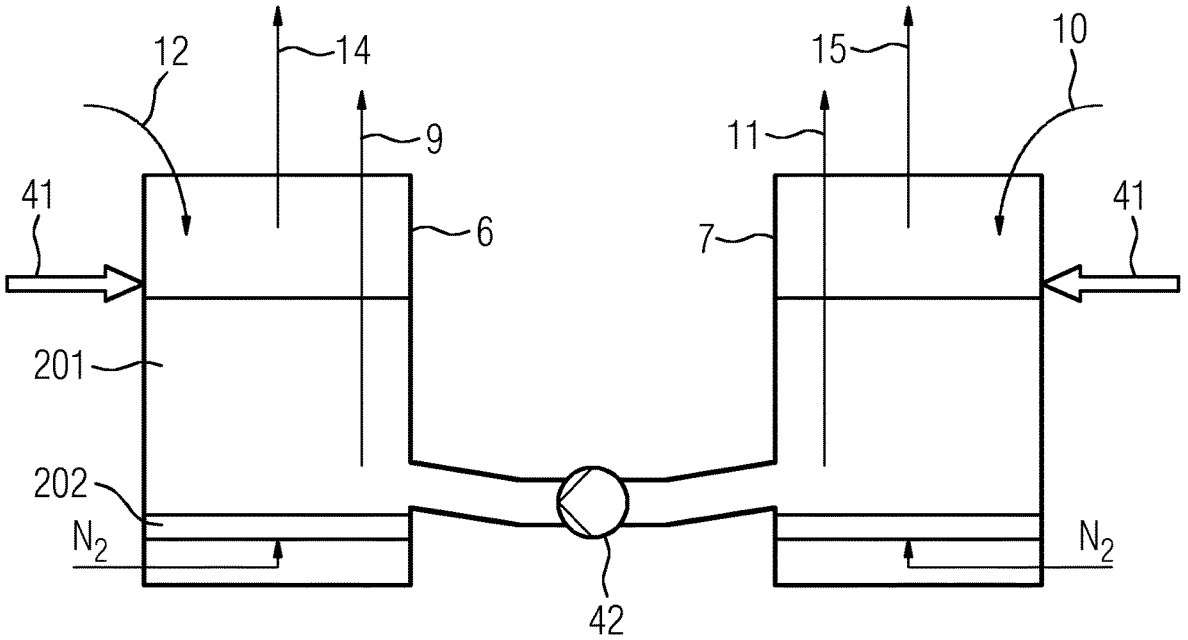
FIG. 4 shows connected electrolyte reservoirs with pump-controlled pressure equalization, according to teachings of the present disclosure.

A further alternative design is shown in FIG. 4. The starting point for this design is that of separate reservoirs 6, 7 like the first exemplary embodiment. In the exemplary embodiment according to FIG. 4, however, there is no provision of pressure equalization for the gas phase. Different pressure in the two reservoirs 6, 7 is therefore able to provide a different electrolyte level, which is not compensated by the equalization pipe, i.e., by the simple connection of the two reservoirs 6, 7.

Equalization in this example is carried out by means of a pump 42. The pump is controlled by control electronics which are not shown in FIG. 4. The input variables used for the control are sensor signals from two fill-level sensors 41, which capture the fill level of the electrolyte in both reservoirs 6, 7. As a result, not only the effect of the pressure in the reservoirs 6, 7 but also a displacement in the level of electrolyte as a result of different flows of electrolyte to the anode chamber 2 and cathode chamber 3 are compensated. These different flows are virtually inevitable, for reasons, among others, of different pumping outputs on the part of the pumps 8.

What is claimed is:

1. An electrolysis system for carbon dioxide utilization, the system comprising:

an electrolysis cell having an anode in an anode chamber and a cathode in a cathode chamber;

the cathode chamber exposing carbon dioxide to contact with the cathode to enable catalysis of a reduction reaction of carbon dioxide to at least one hydrocarbon compound or to carbon monoxide;

first and second electrolyte reservoirs;

a first product gas line leading from the first electrolyte reservoir;

a second product gas line leading from the second electrolyte reservoir;

a first connecting line supplying electrolyte from the first electrolyte reservoir to the anode chamber;

a second connecting line taking electrolyte from the anode chamber off to the second electrolyte reservoir;

a third connecting line supplying electrolyte from the second electrolyte reservoir to the cathode chamber;

a fourth connecting line taking electrolyte from the cathode chamber off to the first electrolyte reservoir; and a pressure-equalizing connection directly connecting the first and second electrolyte reservoirs.

2. The electrolysis system as claimed in claim 1, further comprising a pump in the pressure-equalizing connection.

3. The electrolysis system as claimed in claim 2, further comprising a level sensor for each reservoir.

4. The electrolysis system as claimed in claim 1, wherein the two electrolyte reservoirs comprise a single container having a dividing wall for subdivision into the two electrolyte reservoirs;

wherein the dividing wall comprises an opening providing the pressure-equalizing connection.

5. The electrolysis system as claimed in claim 1, further comprising means for the introduction of inert gas into the reservoirs.

6. The electrolysis system as claimed in claim 1, further comprising a supply line for supplying the carbon dioxide.

7. The electrolysis system as claimed in claim 6, wherein the supply line for supplying the carbon dioxide includes an overpressure valve.

8. The electrolysis system as claimed in claim 6, wherein the supply line and the first product gas line are joined.

9. The electrolysis system as claimed in claim 1, wherein the first product gas joins the second product gas line at an overpressure valve.

10. A reduction method for carbon dioxide utilization with an electrolysis system, the method comprising:

passing carbon dioxide through a cathode chamber of an electrolysis cell to bring the carbon dioxide into contact with a cathode;

reducing the carbon dioxide to a hydrocarbon compound or to carbon monoxide;

passing a first product gas through a first product gas line out of a first electrolyte reservoir;

passing a second product gas through a second product gas line out of a second electrolyte reservoir;

passing electrolyte from the first electrolyte reservoir to an anode chamber of the electrolysis cell;

passing electrolyte from the anode chamber to the second electrolyte reservoir;

passing electrolyte from the second electrolyte reservoir to the cathode chamber;

passing electrolyte from the cathode chamber to the first electrolyte reservoir; and maintaining a shared liquid level in the electrolyte reservoirs by means of a pressure-equalizing connection between the first and second electrolyte reservoirs.

11. The reduction method as claimed in claim 10, further comprising pumping liquid through the pressure-equalizing connection.

12. The reduction method as claimed in claim 11, further comprising activating a pump in the pressure-equalizing connection based on a reading from a level sensor for each reservoir.

13. The reduction method as claimed in claim 10, wherein the two electrolyte reservoirs comprise a single container having a dividing wall for subdivision into the two electrolyte reservoirs; and wherein the dividing wall comprises an opening providing the pressure-equalizing connection.

14. The reduction method as claimed in claim 10, further comprising introducing an inert gas into the reservoirs.

15. The reduction method as claimed in claim 10, further comprising supplying the carbon dioxide through a supply line.

16. The reduction method as claimed in claim 15, wherein the supply line for supplying the carbon dioxide includes an overpressure valve.

17. The reduction method as claimed in claim 15, wherein the supply line and the first product gas line are joined.

18. The reduction method as claimed in claim 10, wherein the product gas lines join at an overpressure valve.

* * * * *